US006015777A

United States Patent [19]

Lostritto, Jr. et al.

[11] Patent Number: 6,015,777

[45] Date of Patent: Jan. 18, 2000

[54] SILICONE GREASES AND METHODS FOR THEIR PRODUCTION

[75] Inventors: Richard T. Lostritto, Jr., Gaithersburg, Md.; Joseph H. Groeger, Storrs, Conn.

[73] Assignee: University of Connecticut, Storrs, Conn.

[21] Appl. No.: 09/060,327

[22] Filed: Apr. 15, 1998

Related U.S. Application Data

[60] Provisional application No. 60/043,944, Apr. 16, 1997.

[51] Int. Cl.[7] ..... C10M 119/30

[52] U.S. Cl. ..... 508/208; 508/126; 508/136; 508/148; 508/165; 508/171; 508/172; 508/173; 508/183

[58] Field of Search ..... 508/126, 136, 508/148, 165, 171, 172, 173, 183, 208

[56] References Cited

U.S. PATENT DOCUMENTS

| | | | |
|---|---|---|---|
| 3,011,975 | 12/1961 | Nitzsche et al. | 508/138 |
| 3,145,176 | 8/1964 | Wright | 508/434 |
| 3,288,712 | 11/1966 | Stark | 508/208 |
| 3,304,259 | 2/1967 | Wright | 508/208 |
| 3,518,188 | 6/1970 | Pirson et al. | 508/208 |
| 4,582,620 | 4/1986 | Mori et al. | 508/208 |
| 4,701,272 | 10/1987 | Mori et al. | 508/136 |
| 4,728,450 | 3/1988 | Toya et al. | 508/208 |
| 4,987,169 | 1/1991 | Kuwata et al. | 524/267 |
| 5,100,568 | 3/1992 | Takahashi et al. | 508/208 |
| 5,227,081 | 7/1993 | Sawa et al. | 508/126 |
| 5,326,804 | 7/1994 | Mistry et al. | 524/188 |
| 5,519,080 | 5/1996 | Matsushita et al. | 524/437 |
| 5,654,362 | 8/1997 | Schulz, Jr. et al. | 524/862 |

*Primary Examiner*—Jerry D. Johnson
*Attorney, Agent, or Firm*—Cantor Colburn LLP

[57] ABSTRACT

Low bleed silicone grease compositions are prepared by blending high viscosity silicone oils with filler materials and/or silicone elastomers. Greases comprise three main types: I) grease comprising high viscosity silicone oil and filler material, II) grease comprising high viscosity silicone oil and silicone elastomer, and III) grease comprising high molecular weight silicone oil and filler material and silicone elastomer.

50 Claims, No Drawings

SILICONE GREASES AND METHODS FOR THEIR PRODUCTION

This application claims the benefit of U.S. Provisional Application No. 60/043,944, filed Apr. 16, 1997, the disclosure of which is incorporated by reference in its entirety.

It is noted that the provisional application includes developmental material, which for the sake of brevity is not included herein; however, as indicated above, U.S. Provisional Application No. 60/043,944 is incorporated by reference in its entirety.

BACKGROUND OF THE INVENTION

1. Field of the Invention

The present invention relates to low bleed silicone greases and to methods for their production. Specifically, this invention relates to silicone grease compositions which maintain lubricity while exhibiting little or no oil bleed even upon long term standing at elevated temperatures and/or environmental exposure. Grease compositions of the present invention maintain lubricity even when in contact with various materials, including copper, aluminum, other metals, elastomers, thermoplastics and ceramics and even in the presence of a low or high voltage electrical fields.

2. Background of the Invention and Related Information

Many silicone greases physically separate allowing the organopolysiloxane "oil" to bleed away from the site of lubrication over time. This is because many silicone greases contain a relatively mobile organopolysiloxane material which is physically thickened with a finely divided mineral filler to give the product a grease-like consistency. However, the organopolysiloxane retains some mobility to a degree which is dependent upon its viscosity and often will eventually bleed away from the site of lubrication.

Oil bleed is a troublesome problem when such greases are exposed to field aging conditions. As the oil bleeds away from the site of lubrication, the physical barrier between mated parts can become compromised and direct contact may result. In some cases, such direct contact of interfaces which are meant to stay lubricated in the field, results in adhesion across the interface which inhibits separation of the parts. In addition, the mineral thickening material which is left behind after the oil bleeds away, acts as an abrasive which further impedes separation.

In certain high voltage applications, such as with load-break elbows, separation failure endangers equipment and personnel. Furthermore, in such accessories, oil bleed off may also result in voltage stresses which exceed design limitations resulting in field failures in the absence of a separation attempt.

The present invention was developed as a result of extensive investigation into the failure mechanisms of various silicone greases for the purpose of solving the oil bleed problem associated with prior art grease compositions. For example, prior art grease compositions contain organopolysiloxanes in the viscosity range of 800 centistokes (cS) to 3500 cS at 25° C. which is too low to be adequately physically stable for many applications. Greases prepared from such oils require very high mineral thickener levels, such as up to 60% w/w to form a grease-like material. As oil bleed occurs, a high level of abrasive mineral thickener is left behind at the previously lubricated interface.

SUMMARY OF THE INVENTION

The present invention is directed to grease compositions which are of low bleed.

The present invention is also directed to methods of producing greases from higher viscosity silicone oils, as well as to greases produced according to these methods. Preferably, such silicone oils have viscosities of from about 5,000 cS to about 200,000 cS at 25° C.

The present invention is further directed to methods of producing greases from crosslinked networks into which higher viscosity silicone oils become physically entrained to reduce bleed in place of using any mineral filler, as well as to greases produced according to these methods.

The present invention is further directed to methods of producing greases from lightly crosslinked networks into which higher viscosity silicone oils become physically entrained to reduce bleed, with small amounts of mineral filler, as well as to greases produced according to these methods.

The present invention is also directed to methods of using the greases of the present invention.

The present invention is achieved by the provision of grease compositions comprising at least one silicone oil exhibiting a viscosity of from about 5,000 cS to about 200,000 cS at 25° C.; and at least one filler material. Preferably, the at least one silicone oil exhibits a viscosity of from about 10,000 cS to about 150,000 cS, and more preferably, from about 12,000 cS to about 100,000 cS. Particularly preferred ranges include viscosities of from about 30,000 cS to about 60,000 cS, from about 12,000 cS to about 60,000 cS, from about 20,000 cS to about 100,000 cS, and from about 20,000 cS to about 40,000 cS.

Preferably, the at least one silicone oil comprises an organosiloxane oil, which preferably comprises an organopolysiloxane oil. In preferred embodiments, the organopolysiloxane oil comprises a member selected from the group consisting of polydialkylsiloxanes, polyalkylarylsiloxanes, polydiarylsiloxanes, and mixtures thereof. Preferably, the organopolysiloxane oil comprises a member selected from the group consisting of polydimethylsiloxane oil, polymethylphenylsiloxane oil, and mixtures thereof.

The grease composition can comprise from about 70% (w/w) to about 99.9% (w/w) silicone oil, more preferably, from about 80% (w/w) to about 98% (w/w) silicone oil, more preferably, from about 85% (w/w) to about 96% (w/w) silicone oil, and most preferably, from about 92% (w/w) to about 96% (w/w) silicone oil.

Preferably, the at least one filler material comprises a particulate material having a mass-weighted mean particle size of less than about 80 micrometers in diameter, more preferably, less than about 40 micrometers in diameter, and most preferably, less than about 20 micrometers in diameter. Preferably, the at least one filler material has a specific surface area greater than about 50 $M^2/g$, more preferably, greater than about 100 $M^2/g$, and most preferably, greater than about 200 $M^2/g$.

The at least one filler material preferably comprises a member selected from the group consisting of colloidal silicon dioxide, hydrophobicized colloidal silicon dioxide, fumed silica, hydrophobicized fumed silica, precipitated silica, hydrophobicized precipitated silica, trimethylated silica, trialkylated silica, fused silica, finely divided quartz, diatomaceous earth, talc, calcium carbonate, zinc oxide, titanium oxide, ferric oxide, glass fiber, glass beads, glass balloons, alumina, silicon carbide, nitrogen carbide, aluminum nitride, boron nitride, manganese carbonate, kaolin, bentonite, carbon black, graphite, cerium hydroxide, and powdered polytetrafluoroethylene, and mixtures thereof. The at least one filler material can be electrically partially conductive or electrically non-conductive. Preferred filler materials comprise silica compounds.

Preferably, the at least one filler material is present at a concentration of from about 0.1% (w/w) to about 30% (w/w), more preferably, from about 2% (w/w) to about 20% (w/w), more preferably, from about 4% (w/w) to about 15% (w/w), and most preferably, from about 4% (w/w) to about 8% (w/w); and preferably up to about 6% (w/w) and even more preferably up to about 5% (w/w).

A particularly preferred composition comprises from about 80% (w/w) to about 90% (w/w) silicone oil exhibiting a viscosity of from about 20,000 to about 40,000 cS at 25° C., and from about 10% (w/w) to about 20% (w/w) filler material. An even more preferred composition comprises about 85% (w/w) silicone oil exhibiting a viscosity of about 30,000 cS at 25° C., and about 15% (w/w) filler material.

The present invention is also achieved by the provision of a grease composition comprising at least one silicone oil exhibiting a viscosity of from about 5,000 cS to about 200,000 cS at 25° C.; and at least one silicone elastomer. As with the previous embodiment, preferably the at least one silicone oil exhibits viscosities and ranges of viscosity as discussed above. Moreover, preferably, the at least one silicone oil comprises an organosiloxane oil, which preferably comprises an organopolysiloxane oil. In preferred embodiments, the organopolysiloxane oil comprises a member selected from the group consisting of polydialkylsiloxanes, polyalkylarylsiloxanes, polydiarylsiloxanes, and mixtures thereof. Preferably, the organopolysiloxane oil comprises a member selected from the group consisting of polydimethylsiloxane oil, polymethylphenylsiloxane oil, and mixtures thereof.

Still further, the silicone oil/silicone elastomer composition preferably comprises from about 40% (w/w) to about 99% (w/w) silicone oil, more preferably, from about 70% (w/w) to about 95% (w/w) silicone oil, more preferably, from about 80% (w/w) to about 90% (w/w) silicone oil, and most preferably, from about 83% (w/w) to about 85% (w/w) silicone oil.

The at least one silicone elastomer can comprise an elastomeric silicone gel. Moreover, the at least one silicone elastomer can comprise a cross-linked reaction product of an organo-alkenyl-polysiloxane compound having at least two silicon-bonded alkenyl radicals per molecule; and an organo-hydrogen-polysiloxane compound having at least two silicon-bonded hydrogen atoms per molecule. Preferably, the at least one silicone elastomer comprises the organo-alkenyl-polysiloxane compound and the organo-hydrogen-polysiloxane compound in a weight ratio of from about 1:2 to about 2:1, more preferably, from about 3:5 to about 5:3, and most preferably, from about 4:5 to about 5:4. Preferably, the organo-alkenyl-polysiloxane compound comprises polymethylvinylsiloxane. The organo-alkenyl-polysiloxane compound can include trimethylated silica. The organo-hydrogen-polysiloxane compound can comprise methylhydrogensiloxane, which can include trimethylated silica.

A catalyst is utilized which catalyzes the reaction between the organo-alkenyl-polysiloxane compound and the organo-hydrogen-polysiloxane compound. Preferably, the catalyst comprises a member selected from the group consisting of finely divided elemental platinum, finely divided platinum dispersed on carbon powder, chloroplatinic acid, chloroplatinic acid/olefin coordination compounds, chloroplatinic acid/vinylsiloxane coordination compounds, tetrakis (triphenylphosphine)palladium, rhodium, and mixtures thereof.

The silicone oil/silicone elastomer composition can preferably comprise from about 1% (w/w) to about 60% (w/w) silicone elastomer, more preferably, from about 5% (w/w) to about 30% (w/w) silicone elastomer, more preferably, from about 10% (w/w) to about 20% (w/w) silicone elastomer, and most preferably, from about 15% (w/w) to about 17% (w/w) silicone elastomer.

A preferred composition comprises from about 10% (w/w) to about 40% (w/w) elastomer and about 60% (w/w) to about 90% (w/w) silicone oil having a viscosity of from about 20,000 to about 40,000 cS at 25° C. A particularly preferred composition comprises from about 10% (w/w) to about 20% (w/w) elastomer and about 80% (w/w) to about 90% (w/w) silicone oil having a viscosity of from about 20,000 to about 40,000 cS at 25° C. An even more preferred composition comprises from about 15% (w/w) elastomer and about 85% (w/w) silicone oil having a viscosity of from about 30,000 cS at 25° C.

The present invention is also achieved by the provision of a grease composition comprising at least one silicone oil exhibiting a viscosity of from about 5,000 cS to about 200,000 cS at 25° C.; at least one silicone elastomer; and at least one filler material. This grease composition can include the same silicone oils, silicone elastomers and filler materials as discussed above. Therefore, as a matter of brevity a description of these components will not be repeated. However, this grease composition preferably comprises from about 10% (w/w) to about 98.9% (w/w) silicone oil, more preferably, from about 50% (w/w) to about 93% (w/w) silicone oil, more preferably, from about 65% (w/w) to about 86% (w/w) silicone oil, and most preferably, from about 75% (w/w) to about 81% (w/w) silicone oil. Moreover, this grease composition preferably comprises from about 1% (w/w) to about 60% (w/w) silicone elastomer, more preferably, from about 5% (w/w) to about 30% (w/w) silicone elastomer, more preferably, from about 10% (w/w) to about 20% (w/w) silicone elastomer, and most preferably, from about 15% (w/w) to about 17% (w/w) silicone elastomer. Still further, in this grease composition, the at least one filler material is preferably present at a concentration of from about 0.1% (w/w) to about 30% (w/w), more preferably, from about 2% (w/w) to about 20% (w/w), more preferably, from about 4% (w/w) to about 15% (w/w), and most preferably, from about 4% (w/w) to about 8% (w/w).

A preferable composition comprises about 4% (w/w) to about 10% (w/w) elastomer, up to about 5% (w/w) filler material, and the balance comprising silicone oil. A particularly preferred composition comprises about 80% (w/w) to about 90% (w/w) silicone oil exhibiting a viscosity of from about 20,000 to about 40,000 cS at 25° C., and about 5% (w/w) to about 15% (w/w) silicone elastomer, and about 4% (w/w) to about 7% (w/w) filler material. An even more preferred composition comprises about 83% (w/w) silicone oil exhibiting a viscosity of about 30,000 cS at 25° C., about 12% (w/w) silicone elastomer, and about 5% (w/w) filler material.

The present invention is still further achieved by the provision of a method of lubricating load break elbows comprising coating at least one portion of the load break elbow with the foregoing greases.

DETAILED DESCRIPTION OF THE INVENTION

The present invention is directed to low bleed silicone greases. Low bleed silicone greases of the present invention are advantageous in that they maintain lubricity while exhibiting little or no oil bleed even upon long term standing at elevated temperatures and/or environmental exposure. Grease compositions of the present invention maintain lubricity even when in contact with various materials, including copper and aluminum; elastomers, including, but not limited to, ethylene-propylene rubber and ethylene-propylene diene monomer rubber; thermoplastics, including, but not limited to, polyethylene, cross-linked polyethylene, and polyesters; and ceramics, including, but not limited to, glass, porcelain, and ceramic materials. In addition, greases of the present invention maintain lubricity even in the presence of a low or high voltage electrical fields, such as in energized or non-energized load break elbows. Greases of the present invention are useful as lubricants, shielding agents, and protective coatings.

Greases produced in accordance with the present invention are characterized by their reduced "bleed." As used herein, the term "bleed" is defined as the tendency of a grease to migrate and/or separate/segregate into its components. Bleed is often described as the migration of the mobile oil components away from the lubricated site. Bleed may be quantified on a relative basis by observing the moving front of oil (in centimeters) on paper over time from an initially applied "lens" of grease. In this instance, bleed is estimated on flat (horizontally) positioned paper.

Grease bleed may be evaluated using a simple grease-drop bleed test. This test evaluates the radial migration of oil outward from an initial "lens" of grease. This test is performed to determine the migration of the grease on filter paper disks, such as Whatman filter paper disks. Briefly, this procedure is performed by placing a "lens" of grease in the center of a filter paper disk, which is preferably at least 8 cm in diameter. The initial lens is preferably no greater than 1 cm in diameter and approximately 2–3 mm thick. The movement of the visible oil front from the outer edge of the lens is measured after about 24 hours at room temperature. Low bleed silicone greases of the present invention preferably exhibit little separation of components under these conditions, and more preferably exhibit no separation at all. Low bleed silicone greases of the present invention preferably exhibit migration distances of from about 0 cm to about 1 cm, more preferably, from about 0 cm to about 0.5 cm, and most preferably, from about 0 cm to about 0.3 cm. When tested in accordance with the aforementioned paper chromatography test, prior art greases exhibit bleeds of 1.5 cm or greater.

Low bleed silicone greases of the present invention are also improved in their ability to maintain consistency under trial use conditions. To explore the degree of compatibility of the newly formulated greases with a material (ethylene-propylene diene monomer rubber, "EPDM" rubber) commonly used to construct both the elbow accessory and also the transformer bushing, a series of weight gain/loss tests may be performed. EPDM rubber material is obtained from a manufacturer of elbow accessories, The Elastimold Corporation. Rubber pancakes approximately 80 mils thick are pressed using a 2-step process. The first involves a 5-minute, one-ton pressing at 90° C. followed by a 15-minute, 10-ton pressing at 160° C. to achieve crosslinking. After pressing into 80-mil thick, 10 inch×10 inch sheets, the EPDM rubber is cut into strips 2 inch long and 0.5 inch wide, washed with ethanol, and allowed to dry. Subsequently, the rubber sheets are precisely weighed and, and then coated with a generous amount of grease to be tested. The grease-coated strips are aged at two temperatures, 80° C. and 110° C., with a 120-day aging cycle. After aging, the grease is stripped in liquid nitrogen. The EPDM rubber strips are then carefully reweighed and the weight change determined. Preferably, the weight change for each temperature is less than about 3%, more preferably less than about 2%, and most preferably, less than about 1%.

In normal use, greases are often used to lubricate interacting surfaces which are intended to be separable. Superior greases will maintain their lubricity while allowing the surfaces to be separated, even after long term use. Inferior greases can become glue-like, often completely preventing separation of the interacting surfaces. To simulate the adhesion between rubber interfaces caused by aging within the elbow accessory over a period of time an adhesion test was devised.

The adhesion test is briefly described as follows. EPDM rubber test strips are produced using the same pressing method described above. The strips produced are about 4 inches by 0.5 inches in size, and 80 mils thick. The strips are cleaned and then coated with the greases and assembled together to form a laminate or sandwich. The assemblies are then clamped with a 2 psi applied pressure, and then inserted into aging ovens at 80° C. and 110° C. for 120 days. After this, the strips are removed and the maximum force required to separate the assemblies is determined using an Instron machine calibrated for loads ranging from zero to about 10 pounds force. Preferably, the force required to separate the strips is less than about 5.5 pound-feet, more preferably, less that about 3.5 pound-feet, and most preferably, less than about 1.5 pound-feet.

Another way of testing the grease's bleed is with a paper chromatography test. This test is performed to determine the maximum migration along vertical 0.5 inch wide filter paper strips, over 10 days at 80° C. This test is performed by dipping the filter paper strip having a length sufficient to include the entire migration of grease, such as a length of at least about 70 cm, into a volume of the grease to be tested. The grease is then allowed to migrate vertically up the strip for 10 days at 80° C. Preferably, migration distances are less than about 20 cm, more preferably, less than about 15 cm, and most preferably, less than about 10 cm.

Another test for gauging field performance is the cable migration test. This test determines the migration tendencies of the greases within cable sections, and is performed using 6 in long underground residential cable sections. The cable is a 7-strand aluminum conductor insulated with 175-mil thick cross-linked polyethylene. The 6.0 inch long sections are cut from longer pieces of cable and their ends were polished using standard metallographic practices to provide a smooth surface. The strands at the reservoir ends of the cable sections are pushed outward by approximately ⅛ inch, and the center conductor is pushed out another 1/16 inch to provide a "wick" for the grease. The sections are cleaned using isopropanol, and are then dried for 24 hours at 80° C. Each cable section is then dipped into a reservoir containing the grease under test. The ends of the cable are enclosed. After assembly, the cable sections are placed upright within an oven for 36 days at 110° C. After this, the sections are removed and cut at lengths 0.5, 2.5 and 4.0 inches from the bottom end containing the grease reservoir. Each section is then rinsed with tetrahydrofuran (THF), which is then analyzed by size exclusion chromatography (SEC) analysis. This information was then used to determine the maximum migration of grease over the aging period. Preferred cable migrations are less than about 5.5 cm, more preferably less than about 4 cm, and most preferably less than about 2.5 cm.

In addition to reduced tendency to migrate and separate, greases of the present invention also exhibit a reduced tendency to degrade in dielectric strength after aging. After examining ASTM test methods D877 and D924 and the Corporate Test Methods from The Dow-Corning Corporation (0114, 0210), a modified dielectric test chamber in conjunction with a standard AC dielectric test set was utilized. A small volume chamber with a variable gap between electrodes was designed and produced to reduce the necessary amount of grease required for the test from the approximately 500 milliliters normally employed. The modified chamber utilized a 0.010 inch gap in conjunction with a 4 kV per minute AC ramp voltage. Greases are tested before and after aging at 80° C. for 120 days. A degradation of dielectric strength to values lower than 40 V/mil is considered clearly unacceptable. Further, a dielectric strength lower than 300 V/mil is also not desirable.

Low bleed silicone greases may be prepared in accordance with the present invention by combining at least one high viscosity silicone oil with at least one filler material and/or with at least one silicone elastomer, in varying proportions. As such, the low bleed silicone greases of the present invention can be broadly divided into three types, based on their compositions: I) grease comprising at least one high viscosity silicone oil+at least one filler material, II) grease comprising at least one high viscosity silicone oil+at least one silicone elastomer, and III) grease comprising at least one high viscosity silicone oil+at least one filler material+at least one silicone elastomer. In addition, greases of the present invention may further contain other materials known in the art. The present greases are not limited in composition to the materials listed herein. The types will be described in more detail hereinafter.

When referring to components throughout this application, unless otherwise noted, reference to a component in the singular also includes combinations of the components. For example, as used herein, the term high viscosity silicone oil is meant to include high viscosity silicone oils, alone and/or in combination. As used herein, the term filler material is meant to include filler materials, alone and/or in combination. Further, as used herein, silicone elastomer is meant to include silicone elastomers, alone and/or in combination.

Type I Greases

Type I low bleed silicone greases are prepared by mixing at least one high viscosity silicone oil with at least one filler material.

The high viscosity silicone oil preferably comprises an organosiloxane oil, and more preferably an organopolysiloxane oil. Organopolysiloxanes useful in low bleed silicone grease I preferably exhibit a viscosity of from about 5,000 cS to about 200,000 cS, at 25° C. More preferably, the at least one silicone oil exhibits a viscosity of from about 10,000 cS to about 150,000 cS, and more preferably, from about 12,000 cS to about 100,000 cS. Particularly preferred ranges include from about 30,000 cS to about 60,000 cS, from about 10 12,000 cS to about 60,000 cS, from about 20,000 cS to about 100,000 cS, and from about 20,000 cS to about 40,000 cS.

It is noted that viscosity is directly proportional to the weight average molecular weight. Therefore, characteristics of the silicone oil are described in terms of the viscosity, instead of the weight average molecular weight. Moreover, preferably, silicone oils for use in the present invention exhibit a polydispersity of less than about 5, more preferably, less than about 3, and most preferably, less than about 2.

The organopolysiloxane may comprise any organopolysiloxane oil, including but not limited to, polydialkylsiloxanes, polyalkylarylsiloxanes, and polydiarylsiloxanes. Examples of organopolysiloxane oils include, but are not limited to, polydimethylsiloxane oil and polymethylphenylsiloxane oil. Silicone greases of type I preferably comprise from about 70% (w/w) to about 99.9% (w/w) high viscosity silicone oil, more preferably, from about 80% (w/w) to about 98% (w/w), more preferably, about 85% (w/w) to about 96% (w/w), and most preferably, from about 92% (w/w) to about 96% (w/w).

The filler material is preferably a particulate material exhibiting a mass-weighted mean particle size less than about 80 micrometers in diameter, more preferably, less than about 40 micrometers in diameter, and most preferably less than about 20 micrometers in diameter. Preferably, particles of the filler material exhibit a specific surface area greater than about 50 $M^2/g$, more preferably, greater than about 100 $M^2/g$, and most preferably, greater than 200 $M^2/g$. Preferably, the filler material should be as clean as practical and of low moisture content as practical (i.e., preferably stored under desiccation conditions).

Examples of suitable filler materials include, but are not limited to, colloidal silicon dioxide, hydrophobicized colloidal silicon dioxide, fumed silica, hydrophobicized fumed silica, precipitated silica, hydrophobicized precipitated silica, trimethylated silica, trialkylated silica, fused silica, finely divided quartz, diatomaceous earth, talc, calcium carbonate, zinc oxide, titanium oxide, ferric oxide, glass fiber, glass beads, glass balloons, alumina, silicon carbide, nitrogen carbide, aluminum nitride, boron nitride, manganese carbonate, kaolin, bentonite, carbon black, graphite, cerium hydroxide, and powdered polytetrafluoroethylene, and mixtures thereof. Particularly preferred filler materials comprise silica compounds.

In addition, the filler may comprise an elastomeric filler material. An elastomeric filler material may be formed by polymerizing the elastomer and then breaking it into small enough particles such that a "filled" elastomer/oil grease is formed, similar in manner to the other filler materials previously discussed. These microsphere-filled lubricants will then exhibit excellent filler-oil interactions. Further, the deformable nature of the elastomer microspheres should allow for better filling of spaces between the rubber interfaces of elbow and transformer bushings.

The filler material is preferably present in the Type I grease at a concentration of from about 0.1% (w/w) to about 30% (w/w), more preferably, from about 2% (w/w) to about 20% (w/w), more preferably from about 4% (w/w) to about 15% (w/w), and most preferably, from about 4% to about 8% (w/w); and preferably up to about 6% (w/w) and even more preferably up to about 5% (w/w). A particularly preferred Type I grease comprises about 80–90% silicone oil with a viscosity of about 20,000–40,000 cS at 25° C., and about 10–20% colloidal silicon dioxide, and even more preferably, about 85% silicone oil with a viscosity of about 30,000 cS at 25° C., and about 15% colloidal silicon dioxide.

The filler material chosen and the amount used in greases of the present invention is preferably based on the end use of the grease product. For example, colloidal silicon dioxide is an example of a filler material which is preferable for use in electrically non-conductive greases, whereas carbon blacks would be useful in at least partially electrically conductive greases. As another example, for applications such as the general lubrication of small and/or slow moving mechanical devices such as gears, hinges, cables, chains, bushings, and bearings, the concentration of the filler material would preferably be lower, whereas in applications such as heavy equipment applications, the concentration of the filler material would preferably be higher.

Type I low bleed silicone greases can be prepared in a variety of manners. Preferably, preparation comprises mixing the at least one high viscosity silicone oil with the at least one filler material. The mixing is preferably performed so that the filler material is thoroughly "wetted" by the silicone oil. The filler material is preferably de-agglomerated and completely dispersed into the high viscosity silicone oil. The mixing may be performed in any manner, such as with a planetary mixer. The type of mixing and duration of mixing time are also not critical, so long as the components of the grease are thoroughly mixed.

Type II Greases

Type II low bleed silicone greases are prepared by combining at least one high viscosity silicone oil with at least one silicone elastomer.

High viscosity silicone oils are described above under Type I greases. High viscosity silicone oils described under Type I greases are acceptable for use in Type II greases as well. Silicone greases of Type II preferably comprise from about 40% (w/w) to about 99% (w/w) high viscosity silicone oil, more preferably, from about 70% (w/w) to about 95% (w/w), more preferably, from about 80% (w/w) to about 90% (w/w), and most preferably, from about 83% (w/w) to about 85% (w/w).

Type II low bleed silicone greases further comprise at least one silicone elastomer, which may comprise an elastomeric silicone gel. As used herein, the term "gel" is meant to include lightly cross-linked elastomers which will flow, but not mechanically rupture under conditions of moderate to high shear. In "gels," sufficient cross-links are usually present to impede flow under low shear. The silicone elastomer preferably comprises (A) an organo-alkenyl-polysiloxane compound containing at least two silicon-bonded alkenyl radicals per molecule, and (B) an organo-hydrogen-polysiloxane compound having at least two silicon-bonded hydrogen atoms per molecule. Silicone elastomers of this type are described in U.S. Pat. No. 4,987,169, to KUWATA et al., the entire contents of which is hereby incorporated by reference as though set forth in full herein. The silicone elastomer preferably comprises components A and B in a weight ratio (A:B) of from about 1:2 to about 2:1, more preferably, about 3:5 to about 5:3, and most preferably from about 4:5 to about 5:4.

Component (A) of the silicone elastomer preferably comprises organo-alkenyl-polysiloxane compounds. Preferably, this component comprises polyalkylvinylsiloxanes or polyalkyl/alellesiloxanes. Preferably, the polyalkylvinylsiloxane comprises polymethylvinylsiloxane. Component (B) of the silicone elastomer preferably comprises organo-hydrogen-polysiloxane compounds. Preferably, this component comprises methylhydrogensiloxane. Components (A) and/or (B) may include a filler such as trimethylated silica filler.

A catalyst is utilized to catalyze the reaction between parts (A) and (B) when mixed. Such catalysts include, but are not limited to, finely divided elemental platinum, finely divided platinum dispersed on carbon powder, chloroplatinic acid, chloroplatinic acid/olefin coordination compounds and chloroplatinic acid/vinylsiloxane coordination compounds. In addition, other metals from the platinum group of the periodic table and compounds of these metals are also useful, including, but not limited to, tetrakis (triphenylphosphine)palladium and rhodium compounds. The catalyst is preferably mixed with at least one of parts (A) and (B), and even more preferably, with at least part (B).

Examples of silicone elastomers which may be used in accordance with the present invention include, but are not limited to, Dow Coming Products Q7-2218, Q7-4850, Q7-2245, and MX4-4210, available from Dow Coming and others.

The silicone elastomer is preferably present in Type II greases at a concentration of from about 1% (w/w) to about 60% (w/w), more preferably, from about 5% (w/w) to about 30% (w/w), more preferably from about 10% (w/w) to about 20% (w/w), and most preferably, from about 15% (w/w) to about 17% (w/w).

A particularly preferred Type II grease comprises about 60–90% silicone oil with a viscosity of about 20,000–40,000 cS at 25° C. and about 10–40% silicone elastomer, and more preferably comprises about 80–90% silicone oil with a viscosity of about 20,000–40,000 cS at 25° C., and about 10–20% silicone elastomer, such as Q7–4580 having an A:B ratio of 1:1, and even more preferably, 85% silicone oil with a viscosity of 30,000 cS at 25° C., and about 15% silicone elastomer, such as Q7-4580 having a ratio of A:B of 1:1.

Type II low bleed silicone greases can be prepared in a variety of manners. Preferably, preparation comprises mixing the at least one high viscosity silicone oil with the at least one silicone elastomer. The components are then thoroughly mixed under conditions of sufficient shear so as to produce a uniform mass. Preferably, during all mixing and handling operations reasonable care should be taken to exclude air and/or atmospheric moisture entrapment. Chemical contamination should also be avoided.

The mixing is preferably performed so that the components are thoroughly mixed. The mixing may be performed in any manner, such as with a planetary mixer. The type of mixing and duration of mixing time are also not critical, so long as the components of the grease are thoroughly mixed.

The mixed components will normally react at room temperature to form the Type II grease. However, to hasten the formation of the end product grease, the mixture of ingredients may be heated up to 140° C., more preferably, 125° C., and most preferably, from about 100° to about 110° C., for a time sufficient such that the center or core of the ingredient mass is exposed to the desired temperature for an adequate period of time to complete the cross-link reaction. Preferably, this exposure time is 120 minutes, more preferably, 60 minutes, and most preferably 30 minutes at a temperature of from about 100° C. to about Type III Greases Type III low bleed silicone greases are prepared by combining at least one high viscosity silicone oil, at least one filler material, and at least one silicone elastomer.

High viscosity silicone oils are described above under Type I greases. High viscosity silicone oils described under Type I greases are acceptable for use in Type III greases as well. Silicone greases of Type III preferably comprise from about 10% (w/w) to about 98.9% (w/w) high viscosity silicone oil, more preferably, from about 50% (w/w) to about 93% (w/w), more preferably, from about 65% (w/w) to about 86% (w/w), and most preferably, from about 75% (w/w) to about 81% (w/w).

Filler materials are described above under Type I greases. Filler materials described under Type I greases are acceptable for use in Type III greases as well. The filler material is preferably present at a concentration of from about 0.1% (w/w) to about 30% (w/w), more preferably, from about 2% (w/w) to about 20% (w/w), more preferably from about 4% (w/w) to about 15% (w/w), and most preferably, from about 4% (w/w) to about 8% (w/w).

Type III low bleed silicone greases further comprise at least one silicone elastomer, which may comprise an elastomeric silicone gel. Silicone elastomers are described above under Type II greases. Silicone elastomers described under Type II greases are acceptable for use in Type III greases as well. The silicone elastomer is preferably present at a concentration of from about 1% (w/w) to about 60% (w/w), more preferably, from about 5% (w/w) to about 30% (w/w), more preferably from about 10% (w/w) to about 20% (w/w), and most preferably, from about 15% (w/w) to about 17% (w/w).

A preferred Type III grease comprises about 80–90% silicone oil with a viscosity of about 20,000–40,000 cS at 25° C., about 5–15% silicone elastomer, such as Q7-4580 having a ratio of A:B of 1:1, and about 4–7% filler material, such as colloidal silicon dioxide, and even more preferably comprises about 83% silicone oil with a viscosity of about 30,000 cS at 25° C., about 12% silicone elastomer, such as Q7-4580 having a ratio of A:B of 1:1, and about 5% filler material, such as colloidal silicon dioxide. Another particularly preferred Type III grease comprises about 85–95% silicone oil, about 4–10% silicone elastomer, and up to about 5% filler material.

Type III low bleed silicone greases can be prepared in a variety of manners. Preferably, preparation comprises mixing the filler material, preferably, so that it is thoroughly wetted, de-agglomerated, and otherwise completely dispersed into the high viscosity silicone oil, preferably under conditions of sufficient shear so as to produce a uniform mass. Silicone elastomer is then added at the desired A:B ratio and then thoroughly mixed. Preferably, during all mixing and handling operations reasonable care should be taken to exclude air and/or atmospheric moisture entrapment. In addition, it is preferable that chemical contamination also be avoided.

The mixed components will normally react at room temperature to form the Type III grease. However, to hasten the formation of the end product grease, the mixture of ingredients may be heated up to 140° C., more preferably, 125° C., and most preferably, from about 100° C. to about 110° C., for a time sufficient such that the center or core of the ingredient mass is exposed to the desired temperature for an adequate period of time to complete the cross link reaction. Preferably, this exposure time is 120 minutes, more preferably, 60 minutes, and most preferably 30 minutes at a temperature of from about 100° C. to about 110° C.

Greases prepared in accordance with the present invention, including any one of Type I, II, and III greases, may further comprise additional components. Such additional components may include those components conventionally utilized in such greases, including fillers, dye pigments, anti-oxidants. Examples of additives known in the art are described in U.S. Pat. No. 5,519,080, to MATSUSHITA et al., the entire contents of which is hereby incorporated by reference as though set forth in full herein.

Greases prepared in accordance with the present invention may be mixed in any manner known in the art. Methods of preparing and mixing silicone-containing compounds are described in U.S. Pat. No. 5,227,081, to SAWA et al., and U.S. Pat. No. 5,654,362, to SCHULZ, JR. et al., the entire contents of both of which are hereby incorporated by reference as though set forth in full herein.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever.

EXAMPLES

Example 1

Type I Low Bleed Silicone Grease

In a hand mixer with an internal volume of approximately 0.5 L, 7 g of polydimethylsiloxane (PDMS)(12,500 cS at 25° C., from Dow Corning, Midland, Mich.) and 7 g of colloidal silicon dioxide (Cab-O-Sil M-5, from Cabot Corporation) (specific surface area 200 $M^2/g$) are mixed with stirring. (The colloidal silicon dioxide should be added slowly and carefully to avoid releasing airborne material which is an inhalation safety hazard.) After this mixing, 86 g more of the PDMS is added slowly with continuous mixing until the entire mass (0.1 Kg total) is well mixed. A translucent grease results which contains 7% w/w filler material. When a "lens" of this grease is placed on absorbent paper, this material exhibits 78% less bleed in 24 hours at room temperature compared to a conventional grease (i.e., GE623, available from General Electric) which comprises approximately 50% filler material.

Example 2

Type II Low Bleed Silicone Grease

In a hand mixer with an internal volume of approximately 0.5 L, a total of 20 g of Dow Corning Q7-4850 elastomer (as 10 g of part A and 10 g of part B) are mixed with 80 g of polydimethylsiloxane (12,500 cS at 25° C., from Dow Corning) until a uniform mixture results. The well mixed mass is placed inside a vacuum chamber and de-aerated at room temperature for 30 minutes; followed by heating at ambient pressure at 100° C. for four hours. A translucent grease results comprising 80% high viscosity silicone oil and 20% silicone elastomer. When a "lens" of this grease is placed on absorbent paper, this material exhibits 94% less bleed in 24 hours at room temperature compared to a conventional grease (i.e., GE623) which comprises approximately 50% thickening filler and does not comprise an elastomer. Additional studies on aged lubricated interfaces of ethylene propylene diene monomer (EPDM) rubber indicate very low oil bleed of grease.

Example 3

Type III Low Bleed Silicone Grease

In a hand mixer with an internal volume of approximately 0.5 L, 7 g of polydimethylsiloxane (12,500 cS at 25° C., from Dow Corning) and 7 g of colloidal silicon dioxide (specific surface area 200 $M^2/g$) are mixed with stirring. (The colloidal silicon dioxide should be added slowly and carefully to avoid releasing airborne material which is an inhalation safety hazard.) After this mixing, 56 g more of the PDMS is added slowly with continuous mixing until this mass is well mixed. A total of 30 g of Dow Corning Q7-2218 elastomer (as 13.3 g of part A and 16.7 g of part B, for a total of 30 g of elastomer) are then mixed in until a uniform mixture results. The well mixed 0.1 Kg mass is placed inside a vacuum chamber and de-aerated at room temperature for 30 minutes; followed by heating at ambient pressure at 100° C. for four hours. A translucent grease comprising 63% high viscosity silicone oil, 30% silicone elastomer, and 7% filler results. When a "lens" is placed on absorbent paper, this material exhibits 94% less bleed in 24 hours at room temperature compared to a conventional grease, i.e., GE623, which comprises approximately 50% filler material and does not comprise an elastomer. Follow-up studies on aged lubricated interfaces of EPDM rubber indicate very low oil bleed of grease.

Table 1 summarizes migration performance of greases according to the present invention labeled as Type I, II, or III, as well as comparative greases labeled as Type C. In the table, compositions of the grease embodiments are shown in the left column. PMPS is used to abbreviate polymethylphenylsiloxane, and PDMS is used to abbreviate polydimethylsiloxane. Fluoro is used to abbreviate trifluoropropylmethyl siloxane oil, 10,000 cS viscosity. The numbers 12,500, 30,000, 60,000, and 100,000, indicate the viscosity of the silicone oil. Elastomers used were MDX44210,Q7-4850, and Q7-2218 (all available from Dow Corning). Ratios for the elastomers indicate the ratio of components A:B (which are described above.). GE623 and DC 111 are commercially available greases available from General Electric and Dow Corning, respectively.

Table 2 shows dielectric test performance for the greases listed in Table 1.

TABLE 1

GREASE MIGRATION PERFORMANCE

| Composition | Type | Cable Migration (cm) | Paper Chromatography (cm) |
|---|---|---|---|
| Fluoro/8% $SiO_2$ | C | 5.5 | 20 |
| Fluoro/6% $SiO_2$ | C | 5.5 | 18 |
| PMPS 30,000/6% $SiO_2$ | I | 1.5 | 7 |
| PDMS 100,000/6% $SiO_2$ | I | 0.5 | 5 |
| PDMS 60,000/6% $SiO_2$ | I | 1.5 | 7 |
| PDMS 12,500/8% $SiO_2$ | I | 5.0 | 17 |
| PDMS 30,000/7% $SiO_2$ | I | 5.0 | 11 |
| MDX4-4210 Xlink 75:1 | C | 0.3 | 10 |
| Q7-4850 Xlink 9.5A:0.5B | C | 0.3 | 3 |
| 50% Q7-2218/PMPS 30,000 | II | 5.5 | 17 |
| 15% Q7-4850/PDMS 12,500 | II | 1.5 | 9 |
| 15% MDX4-4210/PMPS 30,000 | II | 1.5 | 15 |
| GE623 | C | 6 | 70 |
| DC111 | C | — | 25 |
| PDMS 60,000/3% $SiO_2$ | I | 3.3 | 4 |
| PDMS 100,000/4% $SiO_2$ | I | 2.5 | 5 |
| PDMS 12,500/4% $SiO_2$ | I | — | 27 |
| PMPS 30,000/4% $SiO_2$ | I | 1.5 | 13 |
| Fluoro/4% $SiO_2$ | C | 5.5 | 38 |
| PDMS 100,000/2% $SiO_2$ | I | — | 10 |
| PDMS 12,500/6.67% $SiO_2$ | I | — | 17 |
| 12.5% Q7-4850/PDMS 12,500/2% $SiO_2$ | III | 5.0 | 20 |
| 10% Q7-4850/PDMS 12,500/2% $SiO_2$ | III | 5.0 | 27 |
| 15% Q7-4850/PMPS 30,000 | II | — | 11 |
| 10% MDX4-4210/PDMS 12,500/5% $SiO_2$ | III | 6.0 | 21 |
| 5% Q7-4850/PDMS 30,000/3% $SiO_2$ | III | 3.3 | 14 |
| 5% Q7-4850/PDMS 60,000/3% $SiO_2$ | III | — | 7 |
| 5% MDX4-4210/PDMS 60,000/2% $SiO_2$ | III | — | 8 |
| 25% Q7-2218/PDMS 12,500/5% $SiO_2$ | III | 5.0 | 26 |
| 30% Q7-2218/PDMS 12,500/5% $SiO_2$ | III | 6.0 | 24 |
| 5% MDX4-4210/PDMS 30,000/2% $SiO_2$ | III | — | 16 |
| 12.5% MDX4-4210/PDMS 12,500 | II | 5.0 | 5 |
| 10% Q7-4850/PDMS 60,000 | II | 1.5 | 4 |
| 45% Q7-2218/PMPS 30,000 | II | 5.0 | 20 |
| 30% Q7-2218/PMPS 30,000 | II | — | 16 |
| MDX4-4210 Xlink 100:1 | C | 1.5 | 10 |
| 25% Q7-2218 (6A:4B)/PDMS 100,000 | II | — | 12 |
| 10% Q7-2218 (7A:3B)/PDMS 100,000 | II | — | 9 |
| 25% Q7-2218 (7A:3B)/PDMS 100,000 | II | — | 12 |
| 50% Q7-2218 (6A:4B)/PDMS 60,000 | II | — | 17 |
| 25% Q7-2218 (6A:4B)/PDMS 60,000 | II | — | 13 |
| 50% Q7-2218 (7A:3B)/PDMS 100,000 | II | 3.3 | 17 |
| 25% Q7-2218 (6A:4B)/PDMS 30,000 | II | — | 17 |
| 75% Q7-2218 (7A:3B)/PDMS 100,000 | II | 6.0 | 22 |

TABLE 2

GREASE DIELECTRIC PERFORMANCE

| Composition | Type | Unaged Dielectric Strength (V/mil) | Aged Dielectric Strength (V/mil) |
|---|---|---|---|
| Fluoro/8% $SiO_2$ | C | 400 | 400 |
| Fluoro/6% $SiO_2$ | C | 500 | 400 |
| PMPS 30,000/6% $SiO_2$ | I | 550 | 480 |
| PDMS 100,000/6% $SiO_2$ | I | 680 | 400 |
| PDMS 60,000/6% $SiO_2$ | I | 700 | 400 |
| PDMS 12,500/8% $SiO_2$ | I | 750 | 400 |
| PDMS 30,000/7% $SiO_2$ | I | 980 | 400 |
| MDX4-4210 Xlink 75:1 | C | 400 | 400 |
| Q7-4850 Xlink 9.5A:0.5B | C | 480 | <40 |
| 50% Q7-2218/PMPS 30,000 | II | 400 | 250 |
| 15% Q7-4850/PDMS 12,500 | II | 650 | <40 |
| 15% MDX4-4210/PMPS 30,000 | II | 900 | 400 |
| GE623 | C | 650 | 280 |
| DC111 | C | 800 | 350 |
| PDMS 60,000/3% $SiO_2$ | I | 850 | 450 |

TABLE 2-continued

GREASE DIELECTRIC PERFORMANCE

| Composition | Type | Unaged Dielectric Strength (V/mil) | Aged Dielectric Strength (V/mil) |
|---|---|---|---|
| PDMS 100,000/4% $SiO_2$ | I | 780 | 400 |
| PDMS 12,500/4% $SiO_2$ | I | 550 | 250 |
| PMPS 30,000/4% $SiO_2$ | I | 830 | 200 |
| Fluoro/4% $SiO_2$ | C | 520 | 400 |
| PDMS 100,000/2% $SiO_2$ | I | 510 | 400 |
| PDMS 12,500/6.67% $SiO_2$ | I | 800 | 400 |
| 12.5% Q7-4850/PDMS 12,500/2% $SiO_2$ | III | 580 | <40 |
| 10% Q7-4850/PDMS 12,500/2% $SiO_2$ | III | 550 | <40 |
| 15% Q7-4850/PMPS 30,000 | II | 750 | 400 |
| 10% MDX4-4210/PDMS 12,500/5% $SiO_2$ | III | 650 | <40 |
| 5% Q7-4850/PDMS 30,000/3% $SiO_2$ | III | 450 | 600 |
| 5% Q7-4850/PDMS 60,000/3% $SiO_2$ | III | 650 | 480 |
| 5% MDX4-4210/PDMS 60,000/2% $SiO_2$ | III | 780 | 480 |
| 25% Q7-2218/PDMS 12,500/5% $SiO_2$ | III | 800 | 350 |
| 30% Q7-2218/PDMS 12,500/5% $SiO_2$ | III | 800 | 300 |
| 5% MDX4-4210/PDMS 30,000/2% $SiO_2$ | III | 780 | 430 |
| 12.5% MDX4-4210/PDMS 12,500 | II | 610 | 400 |
| 10% Q7-4850/PDMS 60,000 | II | 650 | 600 |
| 45% Q7-2218/PMPS 30,000 | II | 650 | 500 |
| 30% Q7-2218/PMPS 30,000 | II | 700 | 530 |
| MDX4-4210 Xlink 100:1 | C | 480 | 650 |
| 25% Q7-2218 (6A:4B)/PDMS 100,000 | II | 700 | 480 |
| 10% Q7-2218 (7A:3B)/PDMS 100,000 | II | 650 | 780 |
| 25% Q7-2218 (7A:3B)/PDMS 100,000 | II | 700 | 400 |
| 50% Q7-2218 (6A:4B)/PDMS 60,000 | II | 730 | 600 |
| 25% Q7-2218 (6A:4B)/PDMS 60,000 | II | 800 | 550 |
| 50% Q7-2218 (7A:3B)/PDMS 100,000 | II | 1200 | 400 |
| 25% Q7-2218 (6A:4B)/PDMS 30,000 | II | 930 | 450 |
| 75% Q7-2218 (7A:3B)/PDMS 100,000 | II | 900 | 450 |

From the foregoing descriptions, one skilled in the art can easily ascertain the essential characteristics of this invention, and without departing from the spirit and scope thereof, can make various changes and modifications of the invention to adapt it to various usages and conditions.

What is claimed is:

1. A grease composition comprising:

at least one silicone oil exhibiting a viscosity of from about 5,000 cS to about 200,000 cS at 25°; and at least one silicone elastomer gel comprising a cross-linked reaction product of an organo-alkenyl-polysiloxane compound having at least two silicon-bonded alkenyl radicals per molecule and an organo-hydrogen-polysiloxane compound having at least two silicon-bonded hydrogen atoms per molecule.

2. The grease composition of claim 1, wherein the at least one silicone oil exhibits a viscosity of from about 10,000 cS to about 150,000 cS at 25° C.

3. The grease composition of claim 2, wherein the at least one silicone oil exhibits a viscosity of from about 12,000 cS to about 100,000 cS at 25° C.

4. The grease composition of claim 3, wherein the at least one silicone oil exhibits a viscosity of from about 30,000 cS to about 60,000 cS.

5. The grease composition of claim 3, wherein the at least one silicone oil exhibits a viscosity of from about 12,000 cS to about 60,000 cS at 25° C.

6. The grease composition of claim 3, wherein the at least one silicone oil exhibits a viscosity of from about 20,000 cS to about 100,000 cS at 25° C.

7. The grease composition of claim 3, wherein the at least one silicone oil exhibits a viscosity of from about 20,000 cS to about 40,000 cS at 25° C.

8. The grease composition of claim 1, wherein the at least one silicone oil comprises an organosiloxane oil.

9. The grease composition of claim 8, wherein the organosiloxane oil comprises an organopolysiloxane oil.

10. The grease composition of claim 9, wherein the organopolysiloxane oil comprises a member selected from the group consisting of polydialkylsiloxanes, polyalkylarylsiloxanes, polydiarylsiloxanes, and mixtures thereof.

11. The grease composition of claim 1, comprising from about 40% (w/w) to about 99% (w/w) silicone oil.

12. The grease composition of claim 11, comprising from about 83% (w/w) to about 85% (w/w) silicone oil.

13. The grease composition of claim 1, comprising from about 1% (w/w) to about 60% (w/w) silicone elastomer.

14. The grease composition of claim 13, comprising from about 15% (w/w) to about 17% (w/w) silicone elastomer.

15. The grease composition of claim 1, comprising from about 80% (w/w) to about 90% (w/w) silicone oil exhibiting a viscosity of from about 20,000 to about 40,000 cS at 25° C., and from about 8% (w/w) to about 15% (w/w) of silicone elastomer.

16. The grease composition of claim 15, comprising about 85% (w/w) silicone oil exhibiting a viscosity of about 30,000 cS at 25° C., and about 15% (w/w) of silicone elastomer.

17. A method of lubricating load break elbows comprising:

coating at least one portion of the load break elbow with the grease of claim 1.

18. The grease composition of claim 1, comprising from about 60% (w/w) to about 90% (w/w) silicone oil exhibiting a viscosity of from about 20,000 to about 40,000 cS at 25° C., and from about 10% (w/w) to about 40% (w/w) silicone elastomer.

19. A grease composition comprising:

at least one silicone oil exhibiting a viscosity of from about 5,000 cS to about 200,000 cS at 25°; and at least one silicone elastomer gel comprising an organo-alkenyl-polysiloxane compound having at least two silicon-bonded alkenyl radicals per molecule; and an organo-hydrogen-polysiloxane compound having at least two silicon-bonded hydrogen atoms per molecule.

20. The grease composition of claim 19, wherein the at least one silicone elastomer comprises the organo-alkenyl-polysiloxane compound and the organo-hydrogen-polysiloxane compound in a weight ratio of from about 1:2 to about 2:1.

21. The grease composition of claim 19, wherein the organo-alkenyl-polysiloxane compound comprises polymethylvinylsiloxane.

22. The grease composition of claim 19, wherein the organo-hydrogen-polysiloxane compound comprises methylhydrogensiloxane.

23. A grease composition comprising:

at lease one silicone oil exhibiting a viscosity of from about 5,000 cS to about 200,000 cS at 25°; and at least one silicone elastomer gel comprising a cross-linked reaction product of an organo-alkenyl-polysiloxane compound having at least two silicon-bonded alkenyl radicals per molecule and an organo-hydrogen-polysiloxane compound having at least two silicon-bonded hydrogen atoms per molecule; and at least one filler material.

24. The grease composition of claim 23, wherein the at least one silicone oil exhibits a viscosity of from about 10,000 cS to about 150,000 cS at 25° C.

25. The grease composition of claim 24, wherein the at least one silicone oil exhibits a viscosity of from about 12,000 cS to about 100,000 cS at 25° C.

26. The grease composition of claim 25, wherein the at least one silicone oil exhibits a viscosity of from about 30,000 cS to about 60,000 cS at 25° C.

27. The grease composition of claim 25, wherein the at least one silicone oil exhibits a viscosity of from about 12,000 cS to about 60,000 cS at 25° C.

28. The grease composition of claim 25, wherein the at least one silicone oil exhibits a viscosity of from about 20,000 cS to about 100,000 cS at 25° C.

29. The grease composition of claim 25, wherein the at least one silicone oil exhibits a viscosity of from about 20,000 cS to about 40,000 cS at 25° C.

30. The grease composition of claim 23, wherein the at least one silicone oil comprises an organosiloxane oil.

31. The grease composition of claim 30, wherein the organosiloxane oil comprises an organopolysiloxane oil.

32. The grease composition of claim 31, wherein the organopolysiloxane oil comprises a member selected from the group consisting of polydialkylsiloxanes, polyalkylarylsiloxanes, polydiarylsiloxanes, and mixtures thereof.

33. The grease composition of claim 23, comprising from about 10% (w/w) to about 98.9% (w/w) silicone oil.

34. The grease composition of claim 33, comprising from about 75% (w/w) to about 81% (w/w) silicone oil.

35. The grease composition of claim 23, comprising from about 1% (w/w) to about 60% (w/w) silicone elastomer.

36. The grease composition of claim 35, comprising from about 15% (w/w) to about 17% (w/w) silicone elastomer.

37. The grease composition of claim 23, wherein the at least one filler material comprises a particulate material having a mass-weighted mean particle size of less than about 80 micrometers in diameter.

38. The grease composition of claim 23, wherein the at least one filler material has a specific surface area greater than about 50 $M^2/g$.

39. The grease composition of claim 23, wherein the at least one filler material comprises a member selected from the group consisting of colloidal silicon dioxide, hydrophobicized colloidal silicon dioxide, fumed silica, hydrophobicized fumed silica, precipitated silica, hydrophobicized precipitated silica, trimethylated silica, trialkylated silica, fused silica, finely divided quartz, diatomaceous earth, talc, calcium carbonate, zinc oxide, titanium oxide, ferric oxide, glass fiber, glass beads, glass balloons, alumina, silicon carbide, nitrogen carbide, aluminum nitride, boron nitride, manganese carbonate, kaolin, bentonite, carbon black, graphite, cerium hydroxide, and powdered polytetrafluoroethylene, and mixtures thereof.

40. The grease composition of claim 23, wherein the at least one filler material is present at a concentration of from about 0.1% (w/w) to about 30% (w/w).

41. The grease composition of claim 40, wherein the at least one filler material is present at a concentration of from about 4% (w/w) to about 8% (w/w).

42. The grease composition of claim 23, comprising from about 80% (w/w) to about 90% (w/w) silicone oil exhibiting a viscosity of from about 20,000 to about 40,000 cS at 25° C., about 5% (w/w) to about 15% (w/w) silicone elastomer; and about 4% (w/w) to about 7% (w/w) filler material.

43. The grease composition of claim 42, comprising about 83% (w/w) silicone oil exhibiting a viscosity of about 30,000 cS at 25° C.; about 12% (w/w) silicone elastomer, and about 5% filler material.

44. The grease composition of claim 43, wherein said filler material comprises colloidal silicon dioxide.

45. A method of lubricating load break elbows comprising:

coating at least one portion of the load break elbow with the grease of claim 23.

46. The grease composition of claim 23, comprising from about 85% (w/w) to about 95% (w/w) silicone oil, from about 4% (w/w) to about 10% (w/w) silicone elastomer, and up to about 5% (w/w) filler material.

47. A grease composition comprising:

at least one silicone oil exhibiting a viscosity of from about 5,000 cS to about 200,000 cS at 25°; and at least one silicone elastomer gel comprising an organo-alkenyl-polysiloxane compound having at least two silicon-bonded alkenyl radicals per molecule; and an organo-hydrogen-polysiloxane compound having at least two silicon-bonded hydrogen atoms per molecule; and at least one filler material.

48. The grease composition of claim 47, wherein the at least one silicone elastomer comprises the organo-alkenyl-polysiloxane compound and the organo-hydrogen-polysiloxane compound in a weight ratio of from about 1:2 to about 2:1.

49. The grease composition of claim 47, wherein the organo-alkenyl-polysiloxane compound comprises polymethylvinylsiloxane.

50. The grease composition of claim 47, wherein the organo-hydrogen-polysiloxane compound comprises methylhydrogensiloxane.

* * * * *

UNITED STATES PATENT AND TRADEMARK OFFICE

CERTIFICATE OF CORRECTION

PATENT NO. : 6,015,777
DATED : January 18, 2000
INVENTOR(S) : Lostritto, Jr. et al.

It is certified that error appears in the above-identified patent and that said Letters Patent is hereby corrected as shown below:

Column 10,
Line 40, after "about", insert -- 110º C. --

Signed and Sealed this

Eleventh Day of November, 2003

JAMES E. ROGAN
*Director of the United States Patent and Trademark Office*